United States Patent [19]

Smith

[11] 4,386,753

[45] Jun. 7, 1983

[54] LEVELABLE RECEPTACLE LADDER ATTACHMENT

[75] Inventor: LeRoy Smith, Kettering, Ohio

[73] Assignee: Lo-Rich Enterprises, Inc., Miamisburg, Ohio

[21] Appl. No.: 290,944

[22] Filed: Aug. 7, 1981

[51] Int. Cl.[3] ..... E06C 7/14

[52] U.S. Cl. ..... 248/210; 248/311.2

[58] Field of Search ..... 248/210, 211, 309 R, 248/313, 311.2

[56] References Cited

U.S. PATENT DOCUMENTS

| | | | |
|---|---|---|---|
| 1,221,658 | 4/1917 | Berry | 248/311.2 X |
| 2,846,173 | 8/1958 | Grovesteen | 248/210 |
| 2,883,134 | 4/1959 | O'Halloran | 248/210 |
| 3,182,943 | 5/1965 | Crossman | 248/210 |
| 3,987,993 | 10/1976 | Hopkins | 248/210 |
| 4,077,595 | 3/1978 | Carter | 248/210 |

*Primary Examiner*—J. Franklin Foss

*Attorney, Agent, or Firm*—Ralph L. Marzocco

[57] ABSTRACT

A device is disclosed that attaches to either side rail and any rung of an extension ladder and has a receptacle that is free to pivot about the attachment means so as to remain level regardless of ladder inclination.

4 Claims, 2 Drawing Figures

LEVELABLE RECEPTACLE LADDER ATTACHMENT

SUMMARY OF THE INVENTION

This invention relates to a device that can be attached to an extension type ladder and has a receptacle that can accommodate different types of containers that can be maintained level with the ground regardless of the angle of inclination of the ladder. Moreover, the device can be attached to either rail and to any rung of the ladder.

Many times a work situation calling for the use of a two-rail ladder requires that different types of containers be easily accessible to the workman; such as a can of paint to a painter, a bucket of putty to a glazer, a pail of water to a window washer, a bag of nails to a carpenter, etc. Furthermore, for right-handed workmen it is more desirable that a container be at their right side whereas for left-handed workmen it is more desirable that a container be at their left side. On the other hand work situations do arise wherein it is necessary to be able to place a container to the workmen's right or left side regardless of their right handedness or left handedness.

Not only is it desirable and at times necessary that a container be locatable to either the right or left of workmen, but it is desirable that the positioning of a container be easily changed to accommodate workmen as they work along the full extent of a ladder. Further, it is necessary that the levelability of a container be readily maintainable regardless of the ladder's inclination. The foregoing objectives can be achieved by using the device that is the subject of this invention.

It is therefore an object of this invention to provide a device that easily attaches to either ladder rail and at any incremental position along the extent of either ladder rail having a receptacle that is easily maintained level with the ground.

It is a further object of this invention to provide a device having a receptacle that can be used to house workmen's tools and materials.

It is a further object of this invention to provide a device having a receptacle that can be used as a housing for containers of materials used by workmen.

Other objects will become more apparent to those skilled in the art after a consideration of the following detailed description of the preferred embodiment read in conjunction with the accompanying drawings in which.

DETAILED DESCRIPTION OF A PREFERRED EMBODIMENT

Figure 1:
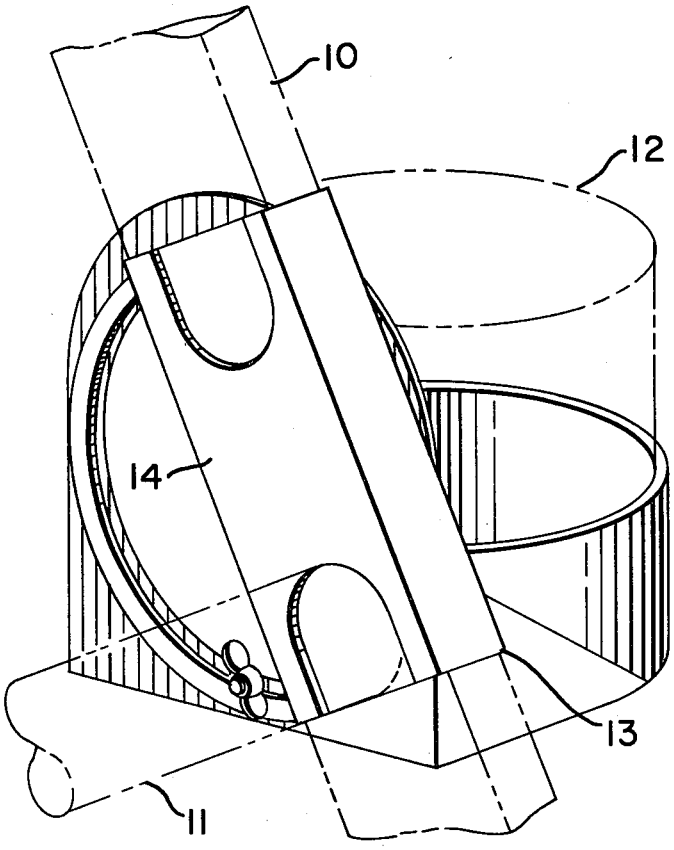
FIG. 1 is a perspective view illustrating the present invention.

Referring to the drawing, an embodiment of this invention, a device that attaches to a side rail 10 and to a rung 11 of an extension ladder to provide support and levelability for a container 12, is illustrated in FIG. 1. The device has rail attachment means 13 so that it can be affixed to either side rail. It is positionable along the full extent of the ladder and is secured in place with rung securing means 14 that can secure the device to any of the ladder's rung. The rail attachment means 13 and the rung securing means 14 co-react with each other to provide firm attachment of the device to a ladder side rail and rung. These and other elements of the invention are perhaps more easily viewed and understood by an examination of the exploded view of the device illustrated in FIG. 2.

Figure 2:
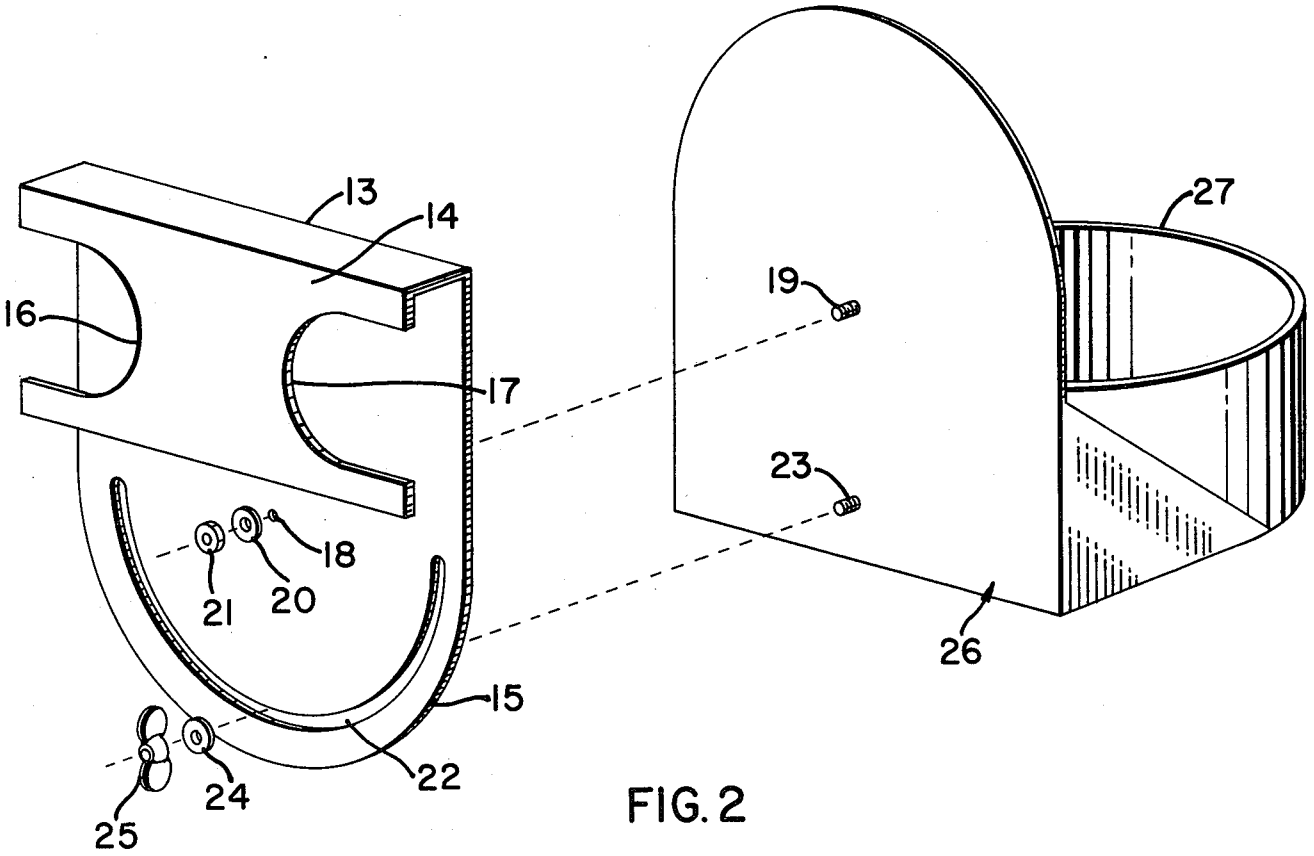
FIG. 2 is an exploded perspective view similar to FIG. 1 wherein the components have been separated to facilitate comprehension of the invention.

Referring to the drawing of the device illustrated in FIG. 2, the rail attachment means 13 and the rung securing means 14 can be fabricated as part of one piece of plate 15 which plate 15 can be either a metallic or non-metallic substance. To accomplish this, the plate 15 is folded twice at 90 degree angles so as to provide a U-channel of sufficient width to fit firmly onto a side rail 10. The length of one leg of such U-channel is slightly less than one-half the length of the opposite leg. The shorter leg of such U-channel has two open-ended slots 16 and 17 of sufficient size and dimension so as to fit firmly onto a ladder rung 11. These open-ended slots 16 and 17 of the rung securing means 14 are positioned opposite to each other so that one will fit onto a ladder rung where it intersects the right ladder rail while the other will fit onto a ladder rung where it intersects the left ladder rail. Thus the rail attachment means 13 co-reacting with the rung securing means 14 permits the device to be positioned either on the right or left ladder rail and at any incremental point from one end of the ladder to the other end. The longer leg of such U-channel of plate 15 contains a centrally located hole 18 which permits the passage of screw 19 through plate 15 and to which washer 20 and nut 21 may be fastened. Such longer leg also contains a semicircular close-ended slot 22 positioned away from the base of such U-channel. Screw 23, which is the same distance from screw 19 as hold 18 is from any point in close-ended slot 22, passes through closed-ended slot 22 and to such screw 23 washer 24 and wing-nut 25 may be fastened.

Screws 19 and 23, which are part of container receiving assembly 26, connect plate 15 and container receiving assembly 26. Nut 21 is fastened but not completely tightened onto screw 19. Sufficient slack remains so that plate 15 and container receiving assembly 26 are free to revolve about each other. After container receiving assembly 26 is positioned so that it is parallel to the ground regardless of the inclination of the extension ladder, be it at any angle from 0 degree to 90 degrees from the horizontal, wing-nut 25 is firmly tightened onto screw 23 locking container receiving assembly 26 in a level position.

Container receiving assembly 26 comprises a vertical plate and a horizontal plate that intersect each other at a 90 degree angle. Onto the horizontal plate is fixed container receiving housing 27 which is cylindrically shaped and open at one end to receive container 12. Although container receiving housing 27 can hold container 12, it is readily apparent that it can also function as a receptacle for other items in addition to containers.

While I have shown and described herein a certain embodiment of my invention, I intend to cover as well any change or modification therein which may be made without departing from its spirit and scope.

I claim as my invention:

1. A device for use with a two-rail ladder having a receptacle that can be positioned to be level with the ground regardless of the angle of inclination of the ladder comprising:
   a. Rail attachment means comprising a U-channel member with the length of one leg less than one-half the length of the other leg;
   b. Rung securing means having two oppositely positioned open-ended slots in the shorter leg of the U-channel member of sufficient size to fit onto a ladder rung;

c. Receptacle support member having a vertical plate perpendicular to a horizontal plate wherein the vertical plate is pivotally and releasably attached to the longer leg of the U-channel member with pivotal means that permit freedom of movement about an axis parallel to the ground;

d. Receptacle locking means whereby a connector affixed to the receptacle support member passes through a semicircular slot incorporated in the longer leg of the U-channel member to a releasable clamping receptor; and e. A receptacle, cylindrically shaped, having an open top and a closed bottom affixed to the horizontal plate of the receptacle support member.

2. The device according to claim 1 wherein the pivotal means comprises a screw fixed to the receptacle support member and passing through a hole in the longer leg of the U-channel member to a tightening nut.

3. The device according to claim 1 wherein the pivotal means comprises a rivet that connects the receptacle support member with the longer leg of the U-channel member.

4. The device according to claim 1 wherein the receptacle locking means comprises a screw fixed to the receptacle support member that passes through the semicircular slot incorporated in the longer leg of the U-channel member to a tightening wing-nut.

* * * * *